US005211187A

United States Patent [19]

Boswell et al.

[11] Patent Number: 5,211,187

[45] Date of Patent: May 18, 1993

[54] STRING DOFFER MECHANISM

[75] Inventors: George S. Boswell; Joao C. A. Gomes, both of Richmond; Joseph P. Maciejczyk, Chester, all of Va.

[73] Assignee: Philip Morris Incorporated, New York, N.Y.

[21] Appl. No.: 550,177

[22] Filed: Jul. 9, 1990

[51] Int. Cl.[5] ..... A24C 5/39; A24B 3/18

[52] U.S. Cl. ..... 131/109.1; 131/109.2; 131/108

[58] Field of Search ..... 131/109.1, 109.2, 108

[56] References Cited

U.S. PATENT DOCUMENTS 973,228 10/1910 Spierer .
1,831,953 11/1931 Fonseca .
2,942,607 6/1960 Skinner .
3,339,258 9/1967 Johnston .
3,355,758 12/1967 Clark .
3,412,446 11/1968 Wood .
4,703,538 11/1987 Silverstrone .
4,809,716 3/1989 Caudill .
4,817,639 4/1989 Caudill .

FOREIGN PATENT DOCUMENTS 26683 of 1906 United Kingdom .

*Primary Examiner*—V. Millin
*Assistant Examiner*—J. Doyle
*Attorney, Agent, or Firm*—Brenda J. Panichi; Christopher P. Godziela

[57] ABSTRACT

A mechanism for removal of contaminants from a stream of material having a plurality of rotatable cylindrical doffer elements each having flights supplied with cleaning means thereon mounted substantially parallel to one another within a frame. The mechanism is provided with means for adjusting both the positions along the frame of the doffer elements as well as the vertical elevation of the doffer elements with respect to the frame.

49 Claims, 9 Drawing Sheets

STRING DOFFER MECHANISM

FIELD OF THE INVENTION

The present invention relates to a string doffer mechanism for removal and separation of undesirable objects such as string and dirt from a material, such as tobacco, before end products can be made from the material. More particularly, the present invention relates to a new doffer design which facilitates removal, cleaning and maintenance of the doffer elements and to a new doffer mechanism which improves contaminant removal from tobacco by facilitating individual adjustment of the position and elevation between doffer elements.

BACKGROUND OF THE INVENTION

It is known that foreign objects, such as dirt and portions of string by which the tobacco leaves are tied together during curing, may be separated and removed from tobacco during preliminary processing by the use of a mechanism consisting of a series of elongated roller elements mounted side-by-side in an open frame or bed. Such a mechanism is disclosed in Caudill U.S. Pat. No. 4,809,716.

In such a mechanism the tobacco is transferred across a series of rotating rollers, or "doffer elements", which are covered by cleaning elements such as brushes. Alternatively, the cleaning elements may be a material containing densely packed resilient hook members, such as Velcro®. The contaminants contained in the tobacco become entwined in the rotating brushes or the Velcro attached to the individual doffer elements. After travelling over the last rotating doffer element, the tobacco is transferred to a separate device, such as a conveyor, and moved to other locations for further processing or storage.

To effectively remove the contaminants from the tobacco, the cleaning brushes or the Velcro must frequently be cleaned of contaminants and periodically replaced. For example, where Velcro® is employed as the cleaning means, as contaminants become trapped on the cleaning surface, the effectiveness of the cleaning surface is reduced. To "reactivate" the cleaning surface, the trapped contaminants must be removed. Additionally, various portions of the mechanism, such as the doffer elements, require maintenance at unpredictable times. Cleaning, replacement, and maintenance require that the mechanism be inoperable and result in system down time. Maintenance of the mechanism and doffer elements that requires removal of the doffer elements is complicated by the fact that the doffer elements disclosed in the prior art each weighs a great deal.

The maintenance or replacement of doffer elements or other components of the mechanism often require disassembling the entire drive mechanism, resulting in further system down time and labor expenses.

It is known that different varieties and grades of tobacco leaf contain different amounts and different size contaminants, and consist of different tobacco particle sizes. Furthermore, the manner in which the tobacco is packaged, transferred, or stored effects the amount, type and size of foreign objects which may contaminate the tobacco. For instance, tobacco leaves which are transferred in bags made of burlap contain pieces of fibers from the burlap, while tobacco leaves which are tied together with string are contaminated with pieces of string which may be larger than burlap fibers.

It is has also been found that variable spacings between the doffer elements provide optimal cleaning for tobacco known to contain certain types of contaminants. Furthermore, different grades of tobacco, which are of differing densities, require different operating parameters in order to be properly cleaned. For example, testing on Bright tobacco has revealed that a 2-inch horizontal gap between all doffer elements results in optimal separation. Elevation changes between doffer elements are not necessary for Bright tobacco. Testing on Bright has also indicated that up to 50% of entrained contaminants can be removed when the doffer elements are rotated at a speed of 150 rpm and the tobacco feed rate is 8,000 pounds per hour.

Testing on Burley tobacco indicates that optimum operating conditions include horizontal gaps of 3-inches between doffer elements, doffer element rotational speeds of 150 rpm and tobacco feed rate of 8,000 pounds per hour. It has also been concluded that for Oriental tobacco, the optimum set up is a 1.5-inch gap between successive doffer elements, doffer element speed of 150 rpm and tobacco feed rate of 8,000 pounds per hour. It has been found that for both Burley and Oriental tobacco, as well as for Bright tobacco, that the doffer elements should be fixed in the same plane in order the achieve optimal separation.

Although testing on Bright, Burley and Oriental tobaccoes has indicated that change in the elevation of the doffer elements relative to the frame are not prerequisite to successful operation of the mechanism, elevational changes may be useful when other grades of tobacco or other materials must be cleaned of contaminants. The agitation caused by placing one or more doffer elements at a different elevation from the remaining doffer elements may be necessary for cleaning certain materials.

Therefore, it can be seen that the mechanism's operating conditions must be adjustable in order to obtain optimal separation and removal of contaminants from different varieties of tobacco, as well as from other materials.

With respect to mechanisms currently in use, the adjustability of most of the operating conditions is limited. That is, current mechanisms contain an invariable number of doffer elements at fixed horizontal gaps and vertical elevations. Therefore, operating conditions of current mechanisms cannot be varied, or require large amounts of down time to adjust conditions for cleaning different types and grades of tobacco.

Accordingly, it is desirable to provide a doffer mechanism which allows for easy adjustment of both the horizontal gap between successive doffer elements and the vertical elevation of individual doffer elements relative to the frame. It is further desirable for such mechanism to allow for easy removal and replacement of individual doffer elements for maintenance and replacement of the cleaning means.

Further, there is a need for a doffer mechanism which allows for reduced system down time for the cleaning, maintenance, or replacement of the doffer cleaning means and of the doffer mechanism.

Further, there is a need for a doffer mechanism drive design to facilitate such adjustments, cleaning, maintenance, or replacement of doffer cleaning means.

Still further, there is a need for light weight doffer elements to facilitate maintenance, cleaning, and replacement of the doffer mechanism and the doffer elements.

It is an object of the present invention to provide an improved doffer mechanism for removing and separating contaminants and other objects from tobacco.

It is a further object of this invention to provide a doffer mechanism which allows for reduced system down time for cleaning and maintenance of the doffer mechanism and doffer elements.

It is a further object of this invention to provide lightweight doffer elements and a doffer mechanism which allows for easy removal of the doffer elements for maintenance as well as replacement of cleaning elements attached to the doffer elements.

It is also an object of this invention to permit variation in the operating conditions of the mechanism. The mechanism of the present invention allows for easy adjustment of the horizontal gap between successive doffer elements and easy adjustment of the vertical elevation of individual doffer elements relative to the frame to optimize tobacco surface contact with the doffer cleaning means for various types and grades of tobacco. The frames of the mechanism of the present invention can also be installed at an upwardly inclined angle if operating conditions so dictate.

It is a further object of this invention to provide an improved drive design to facilitate such aforementioned adjustments, cleaning, maintenance and replacement of the doffer elements and the cleaning means attached to the doffer elements.

SUMMARY OF THE INVENTION

In accordance with one embodiment of the invention, a doffer mechanism for the removal of contaminants from tobacco includes a plurality of doffer elements mounted parallel to one another within a frame, each doffer element having cleaning flights located thereon. The doffer elements are rotated about their axes in the same direction and are driven by a continuous chain which allows for easy individual adjustment of the gap between doffers.

In accordance with another embodiment of the invention, the elevation of one or more doffer elements above or below the frame can be readily and easily adjusted.

In yet another embodiment of the invention, a pair of frames, each frame containing a plurality of doffer elements, are provided. The pair of frames is connected to one another by a subframe such that each frame can be pivoted from a first, substantially horizontal position during which the doffer elements in that frame are operable to a second, substantially upright position during which the doffer elements in that frame can be cleaned.

Other embodiments of the invention may consist of a pair of frames which remain unconnected and a flop or pantleg gate. In these embodiments, the gate can be used to direct the flow of the material to be cleaned to one frame while the other frame is idle and can be cleaned. In these embodiments, the frames can be located parallel to one another or can be oppositely inclined from one another.

In accordance with the invention, there is provided a doffer element which is hollow and generally tubular in shape and which has a cleaning surface affixed at various locations. A drive assembly for driving the plurality of doffer elements within the frame is also provided. The drive assembly consists of continuous chain, a drive means such as a motor, a plurality of doffer sprockets attached to the doffer elements and a plurality of idler sprockets. The doffer sprockets engage the exterior side of the chain that such that the doffer elements may be removed for cleaning and maintenance without disrupting the path of the chain.

BRIEF DESCRIPTION OF THE DRAWINGS

FIG. 1(*a*) is a 3-D end view of a doffer element used in conjunction with the mechanism of the present invention, illustrating the cleaning means.

DETAILED DESCRIPTION OF THE DRAWINGS

Reference now should be made to the drawings in which the same reference numbers are used throughout the different figures to designate the same components.

Figure 1:
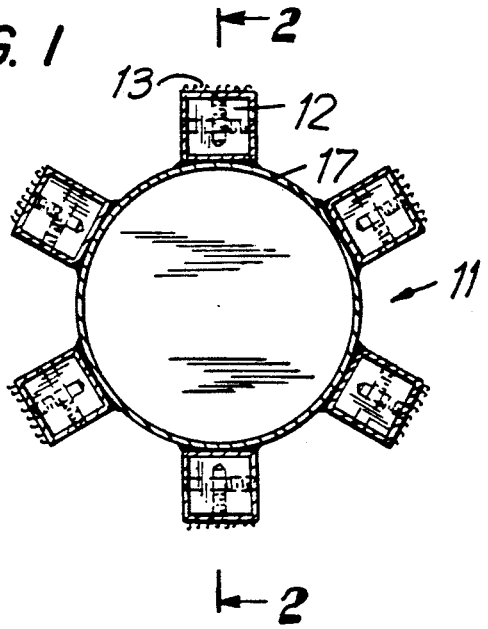
FIG. 1 is a cross sectional view of a doffer element used in conjunction with the mechanism of the present invention.
Figure 2:
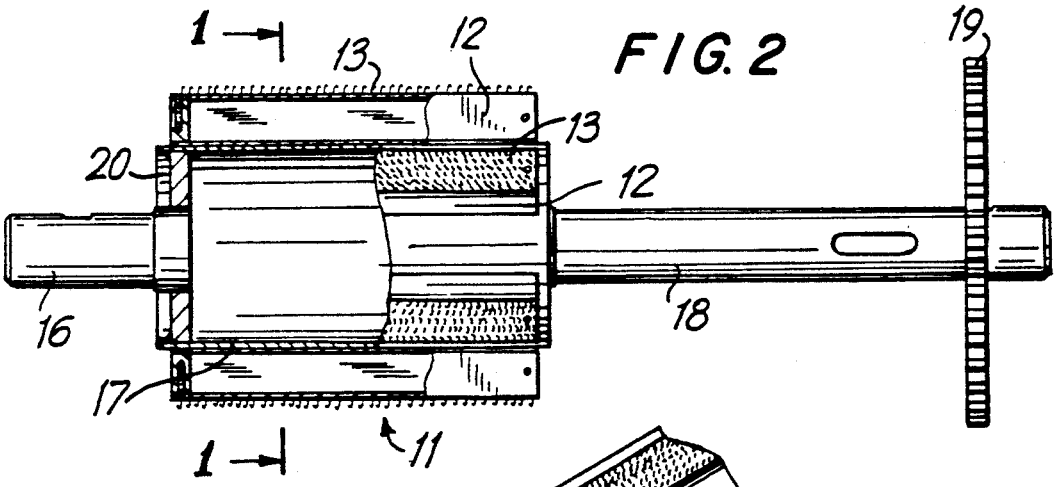
FIG. 2 is a longitudinal sectional view of a doffer element used in the present invention, illustrating the shafts which connect the element to the frame assembly.
Figure 1A:
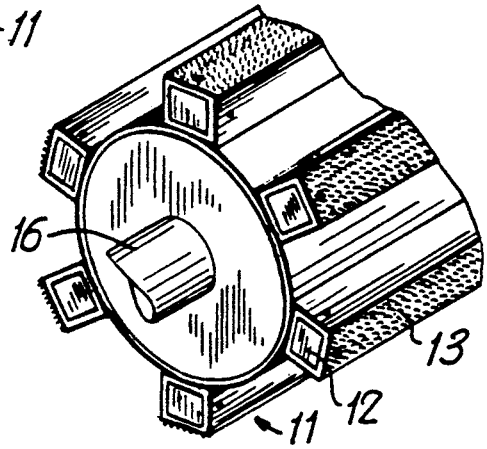

The rotatable doffer elements of the present invention will now be described in detail. As shown in FIGS. 1 and 2, rotatable doffer elements 11 each include a hollow metal tube 17. The ends of doffer elements 11 are affixed to hollow metal shafts 16 and 18 by means of circular metal plates 20 located at each end of tube 17. Plates 20 are affixed to tube 17 by means of screws or a weld or any other means generally known in the art. Plate 20 supports the tube 17 and provides a means for affixing the shafts 16 and 18. Doffer sprocket 19 is affixed to shaft 18 so that rotation of doffer sprocket 19 will cause doffer element 11 to rotate about its longitudinal axis.

As further discussed below, hollow tube 17 of each doffer element 11 is preferably 37½ inches long and is preferably 4 inches in diameter. The design of these doffer elements differs from other rotatable elements which are comprised of substantially solid metal. Thus, the doffer elements of the present invention weigh much less than those currently in use, while providing the required structural integrity and durability required of string doffer mechanisms.

Flights 12 are attached along the length of the outer surface of the tube 17. Preferably, flights 12 are hollow metal protuberances extending in a longitudinal direction along the tube 17. Most preferably flights 12 consist of six 1-inch square paddles welded to each doffer at equal distances about the circumference of tube 17. Attached to the top surface of flights 12 is cleaning means 13. Attachment of the cleaning means 13 may be by any known means such as by adhesive. Screwing the cleaning means 13 onto the flight 12 by providing several screw holes in the flight and cleaning means prevents lifting while allowing for easy removal and replacement of cleaning means 13 and is thus preferred.

Preferably, cleaning means 13 consists of a hook material such as Velcro® and is attached only to the top surfaces of the flights. Most preferably, cleaning means 13 is white in color, thereby allowing for easy detection of contaminants which become entwined therein. Alternatively, all surfaces of flights 12 and all exposed surfaces of metal tube 17 may be covered with a cleaning means. However, because the tobacco tends to almost exclusively engage the top surfaces of the flights, covering only the top surfaces of the flights is preferred. FIG. 1(*a*) illustrates the preferred placement of cleaning means 13.

Cleaning and replacement of the cleaning means is less expensive and time consuming when only the top surfaces of the flights are covered. Cleaning may be accomplished by hand using a spring steel curry comb and should be performed as often as possible to increase the efficiency of the mechanism.

One embodiment of the mechanism consists of a single doffer unit. As can be seen from the top view shown in FIG. 3, the doffer unit consists of a frame 10 and doffer elements 11. Doffer elements 11 are generally cylindrical and rotate simultaneously in the direction of product flow.

The number and size of doffer elements 11 is a matter of design choice. Preferably, each doffer element 11 has a maximum length of 37½ inches and a diameter of approximately 4 inches.

Figure 3:
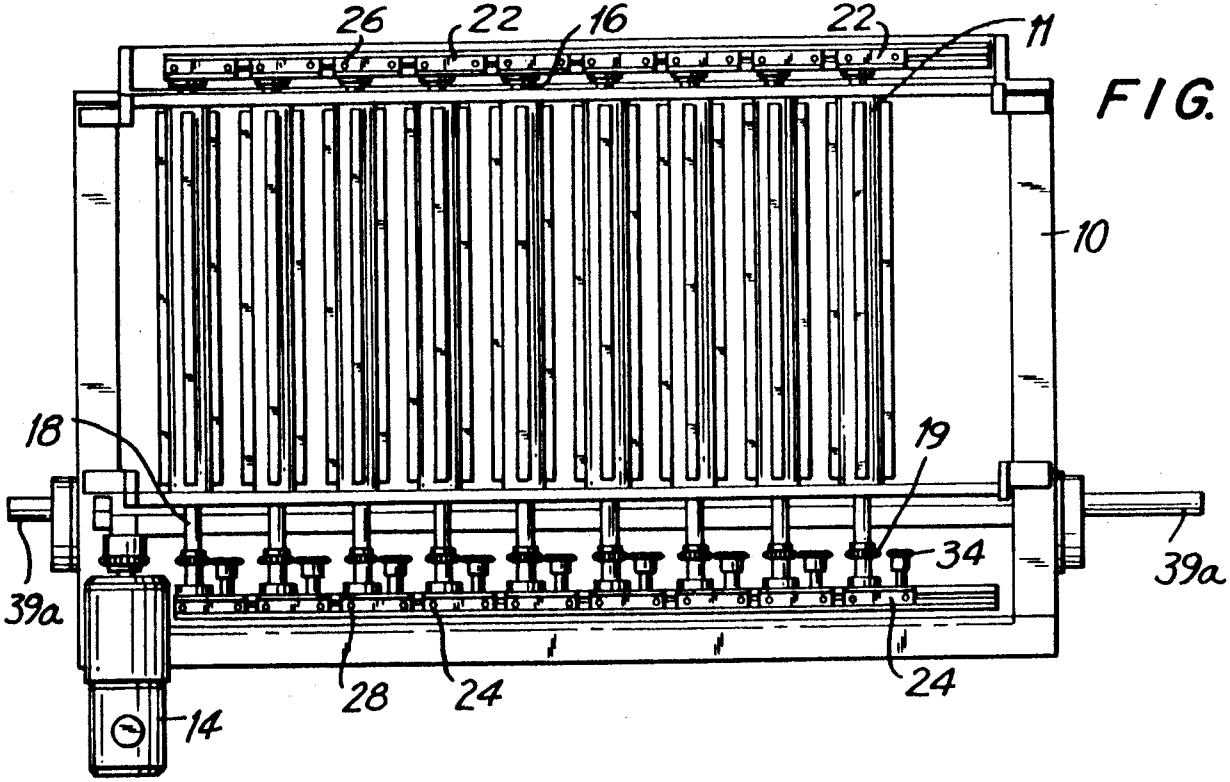
FIG. 3 is a top view of the frame containing the doffer elements mounted parallel to one another.
Figure 4:
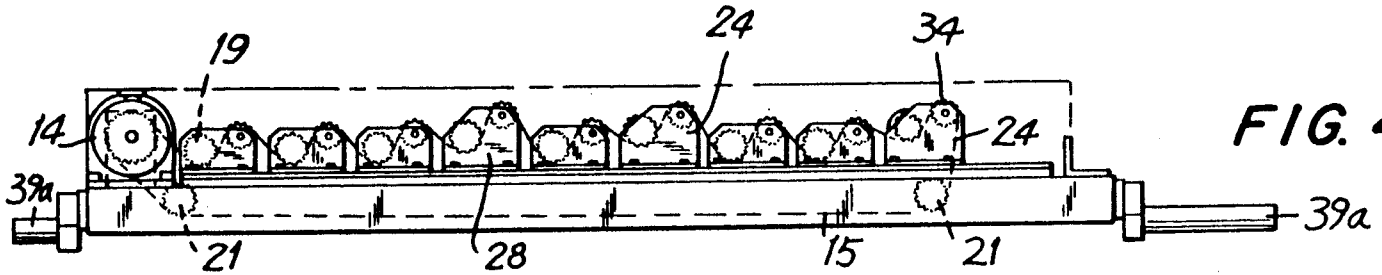
FIG. 4 is a drive side view of the frame and drive means of the present invention.

As shown in FIGS. 3 and 4, (FIG. 4 being a side view), doffer elements 11 are attached to frame 10 via shafts 16 and 18 by means of blocks 22–28. Blocks 22–28 may be fixedly mounted to frame 10, as was conventionally done prior to the present invention. Alternatively, the blocks may be slidably mounted to frame 10, as will be described below.

Figure 6:
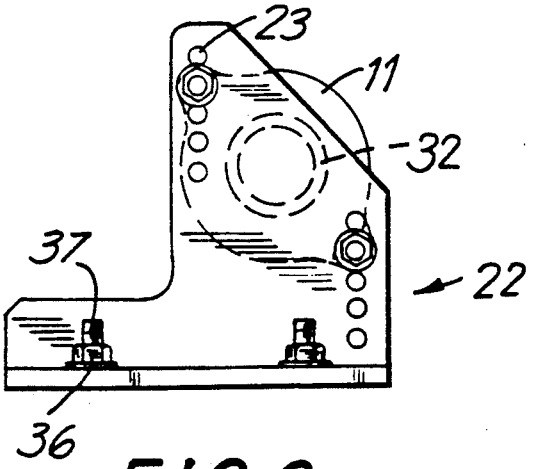
FIG. 6 illustrates the adjustable slider blocks located on the following side of the mechanism that are used in conjunction with vertically adjustable doffer elements.
Figure 7:
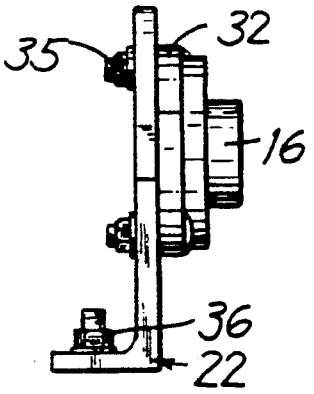
FIG. 7 is a side view of the block of FIG. 6.
Figure 8:
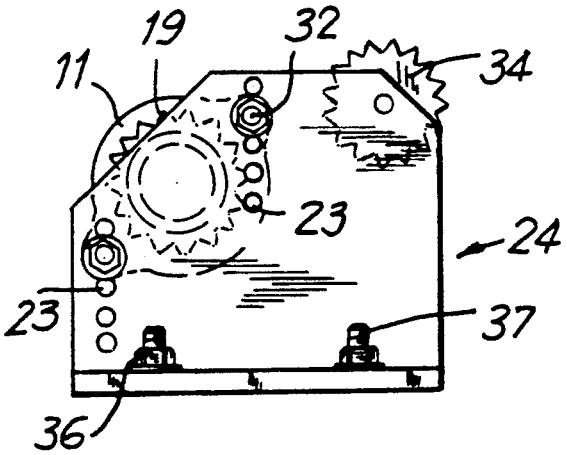
FIG. 8 illustrates the adjustable slider blocks located on the driving side of the mechanism that are used in conjunction with vertically adjustable doffer elements.
Figure 9:
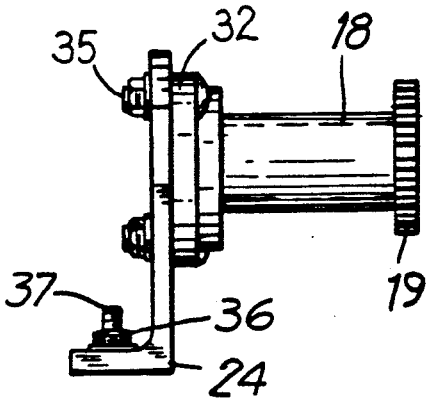
FIG. 9 is a side view of the block of FIG. 8.

As shown in FIGS. 6–13, bearing mounts 32 are attached to differing types of blocks 22–28, such as by bolts 35. Bearing mounts 32 support shafts 16 and 18 of doffer elements 11. The bearing mount and block design illustrated in FIGS. 6–9 permits vertical or elevation adjustments to doffer elements 11. (As used in this sense, the terms "vertical" or "elevation" refer to the distance of the doffer element from an imaginary plane lying on the frame. Thus, if the frame is situated horizontally the "elevation" of the doffer element from the frame corresponds to its vertical distance from the frame.) FIGS. 6 and 7 show adjustable block 22 that supports shaft 16. Adjustable block 22 is located on the side of the mechanism opposite the driving means for the doffer elements 11. FIGS. 8 and 9 show drive side adjustable block 24 that supports shaft 18 and includes sprocket 34 that is rotatably affixed to block 24 using conventional means. Doffer sprocket 19 is also shown. Sprocket 34, which is shown in FIG. 8 and FIG. 3, is not shown in FIG. 9 for clarity.

In this design, the blocks 22 and 24 are provided with a plurality of pairs of holes 23. By unbolting both bearing mounts 32 from blocks 22 and 24 and then moving bearing mounts 32 to another set of holes, the elevation of doffer element 11 relative to frame 10 can be adjusted. Preferably, the range of elevation adjustment is limited to two inches. The blocks shown in FIGS. 6–9 can be adjusted to five different elevations.

Figure 10:
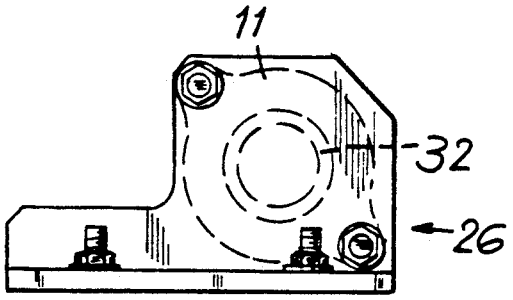
FIG. 10 illustrates the blocks located on the following side of the mechanism that are used in conjunction with stationary doffer elements.
Figure 11:
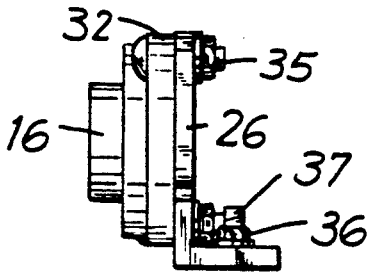
FIG. 11 is a side view of the block of FIG. 10.
Figure 12:
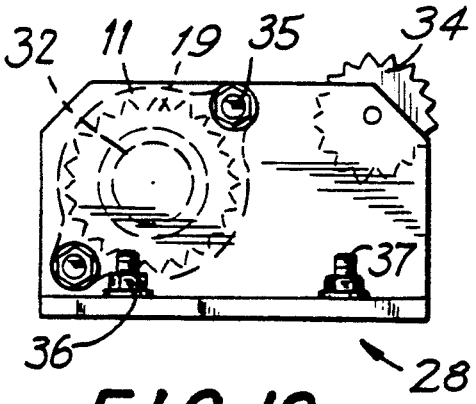
FIG. 12 illustrates the blocks located on the driving side of the mechanism that are used in conjunction with stationary doffer elements.
Figure 13:
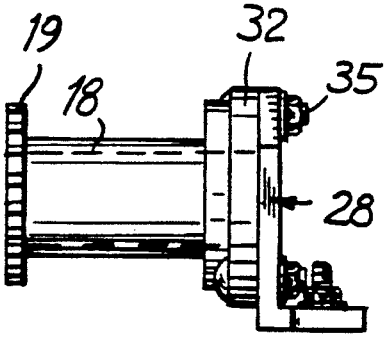
FIG. 13 is a side view of the block of FIG. 12.

The bearing mount designs illustrated in FIGS. 10–13 operate in the same manner as those illustrated in FIGS. 6–9. However, because blocks 26 and 28 do not permit vertical adjustment to doffer elements 11, they contain only one pair of holes for receiving bearing mount 32 as opposed to the plurality of hole pairs contained in adjustable block 22 and drive side adjustable block 24. FIGS. 10 and 11 show block 26 which supports shaft 16 in bearing mount 32. Block 26 is located on the side of the mechanism opposite the driving means for the doffer elements 11. FIGS. 12 and 13 show drive side block 28 which supports drive shaft 18. Drive side block 28 includes sprocket 34 that is rotatably affixed to block 28 using conventional means. Doffer sprocket 19 is shown. Sprocket 34, which is shown in FIG. 12 and FIG. 3, is not shown in FIG. 13 for clarity.

Figure 5:
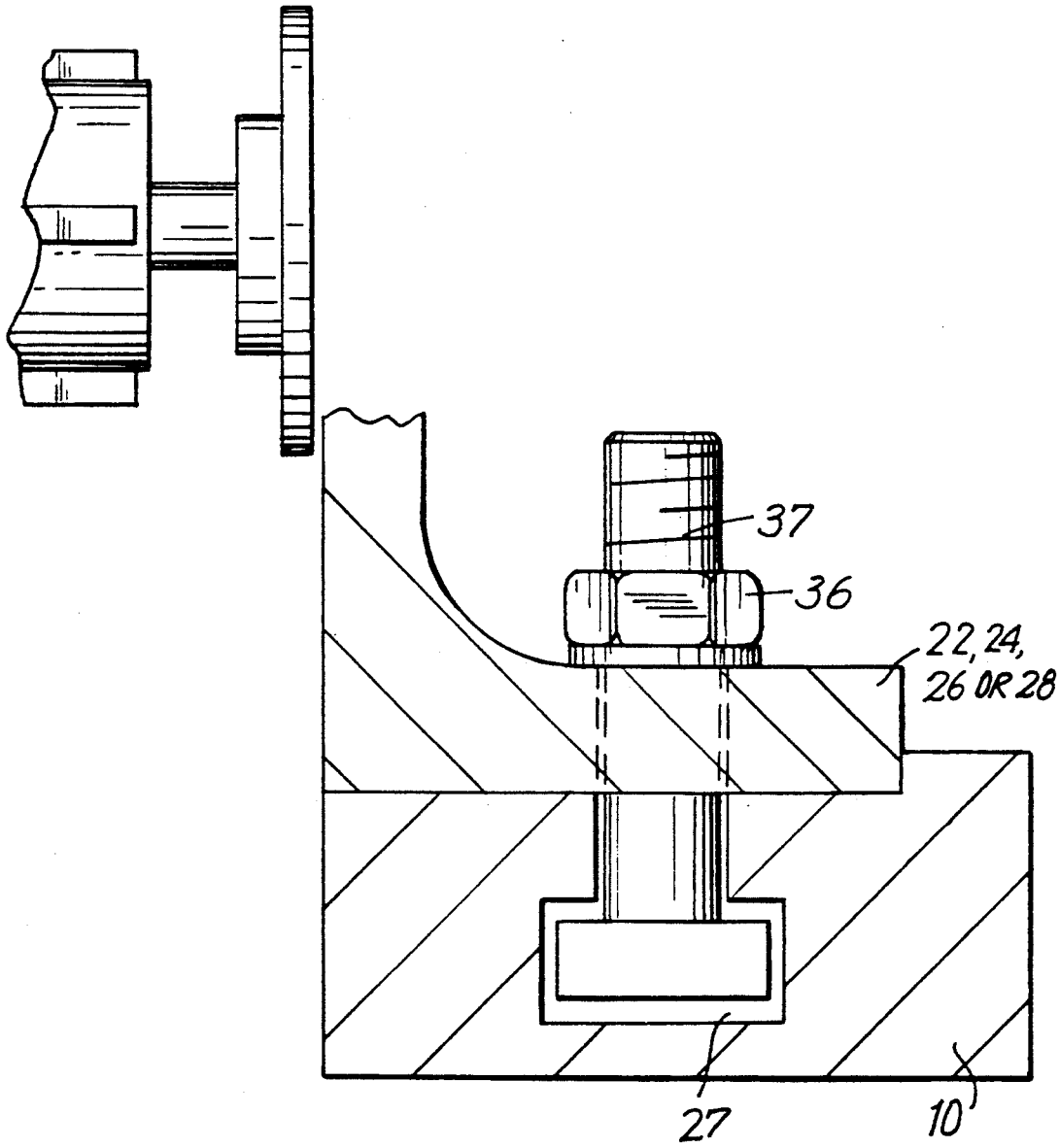
FIG. 5 is a sectional view of a T-slot bolt, a portion of an adjustable slider block and a portion of the frame.

The means for attaching blocks 22–28 to frame 10 provides for continuously variable adjustment of the horizontal gap between successive doffer elements 1; As shown in FIG. 5, the frame 10 is provided with T-shaped groove 27 along the length of each of its sides. Blocks 22–28 can be slidably mounted to frame 10 by means of two T-bolt 37, the head of which fits into T-shaped groove 27. When horizontal adjustment is desired, nut 36 of T-bolt 37 is loosened and block 22, 24, 26, or 28 is moved along the T-shaped groove located within frame 10 to its desired position. Then nut 36 of T-bolt 37 is re-tightened. Thus, blocks 22–28 and doffer elements 11 which are supported by blocks 22–28 can be positioned at any particular position along frame 10. Preferably, each block is fastened to frame 10 by two T-bolts 37 and two nuts 36. Preferably, each block 22–28 can be slid between 0 and 3 inches along the frame 10.

As mentioned earlier, the doffer elements 11 are rotatable about their axes in bearings 32 which are mounted on frame 10 by blocks 22–28. Doffer sprockets 19 of doffer elements 11 are driven by a continuous chain 15, as illustrated in FIG. 4. For clarity, chain 15 is not illustrated in FIG. 3, which is a top view of frame 10 with doffer elements 11. Chain 15 is driven by drive motor/gear reducer 14 which is located on the feed end of the doffer unit. Chain 15 passes around guide sprockets 21 which are located beneath frame 10. Guide sprockets 21 aid in the maintenance of the proper amount of tension in chain 15.

The path of chain 15 runs below the doffer sprockets 19 mounted on each shaft 18 and over idler sprockets 34 mounted to blocks 22–28 by means of idler sprocket bearings. Thus doffer sprockets 19 are located outside of the loop formed by continuous chain 15. This drive arrangement permits doffer elements 11 to be removed for maintenance or for horizontal or vertical adjustment without disturbing the path of chain 15. When removal or adjustment is desired, bearing mounts 32 are unbolted and doffer element 11 is lifted away from blocks 22, 24, 26, or 28.

Alternatively, a tensioned belt can be substituted for chain 15, and the sprockets can be replaced with drums. Chain 15 and sprockets are preferred, however.

In the preferred embodiment of the present invention, frame 10 supports nine doffer elements 11. It has been found that contaminant removal efficiency increases as the doffer element surface area increases due to improved tobacco distribution and contact with the cleaning means; therefore, it is advantageous to use a plurality of doffer elements.

Preferably, the mechanism is provided with adjustable blocks 22 and drive side adjustable blocks 24 for adjusting the vertical elevation of doffer elements 11. Adjustable blocks 22 and drive side adjustable blocks 24 are paired opposite one another along frame 10 only at specific locations. Blocks 22 and 24 are preferably installed at doffer element locations 4, 6 and 9, with location 1 at the feed end of the mechanism.

The doffer mechanism of the present invention is supplied as three separate designs: a right hand drive assembly, a left hand drive assembly, and a "flop" style assembly. The right hand and left hand drive assemblies consist of a single frame unit of doffers, as shown in FIG. 3. (FIG. 3 depicts the right hand drive assembly.) The single unit assemblies were created for low clearance installations. In order to suit the particular installation, these assemblies can have the drive assembly on the right or the left side.

Figure 14:
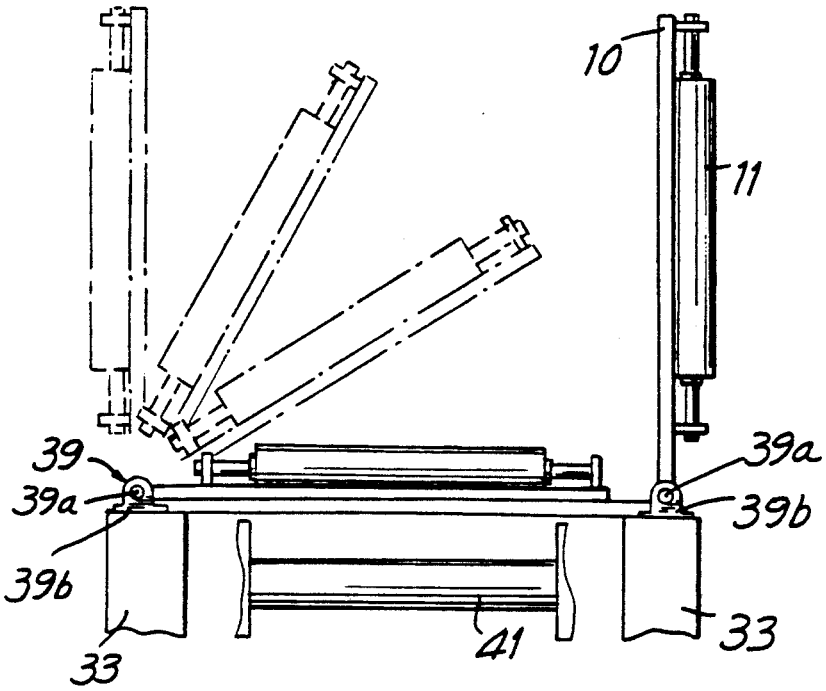
FIG. 14 is a diagrammatic end view of a preferred embodiment of the present invention illustrating the "flop" arrangement of the frames.

The flop style assembly, as illustrated in FIG. 14, is essentially a utilization of both the right hand assembly and the left hand assembly held together by subframe 33. Motor/gear reducers 14, which are not shown in FIG. 14 for clarity, are preferably located on the pivoting side of the frame 10. One side of each of the two frames 10 is attached to pivot means 39, which comprises stub shafts 39*a*, which are attached to the ends of frame 10, and bushing blocks 39*b*, which are attached to subframe 33. Pivot means 39 could also be any other pivoting arrangement known in the art. The flop assembly is preferred because the contaminant removal efficiency is much higher than for a single frame doffer unit. This is because the assembly can be cleaned more often without substantial down time. Operation of the flop assembly has shown that the doffer elements 11 can be regularly cleaned every 2–3 hours with minimum down time. As shown in FIG. 14, one doffer unit operates in a substantially horizontal position while the other doffer unit is cleaned or maintained in an upright position. Tilt bed motors 50 and gear boxes 51 are not shown in FIG. 14 for clarity.

The top view of a frame 10 shown in FIG. 3 also shows stub shafts 39*a*. Also shown is motor/gear reducer 14, which is preferably positioned to counterbalance the weight of frame 10 and doffers 11 about pivot means 39.

Figure 14A:
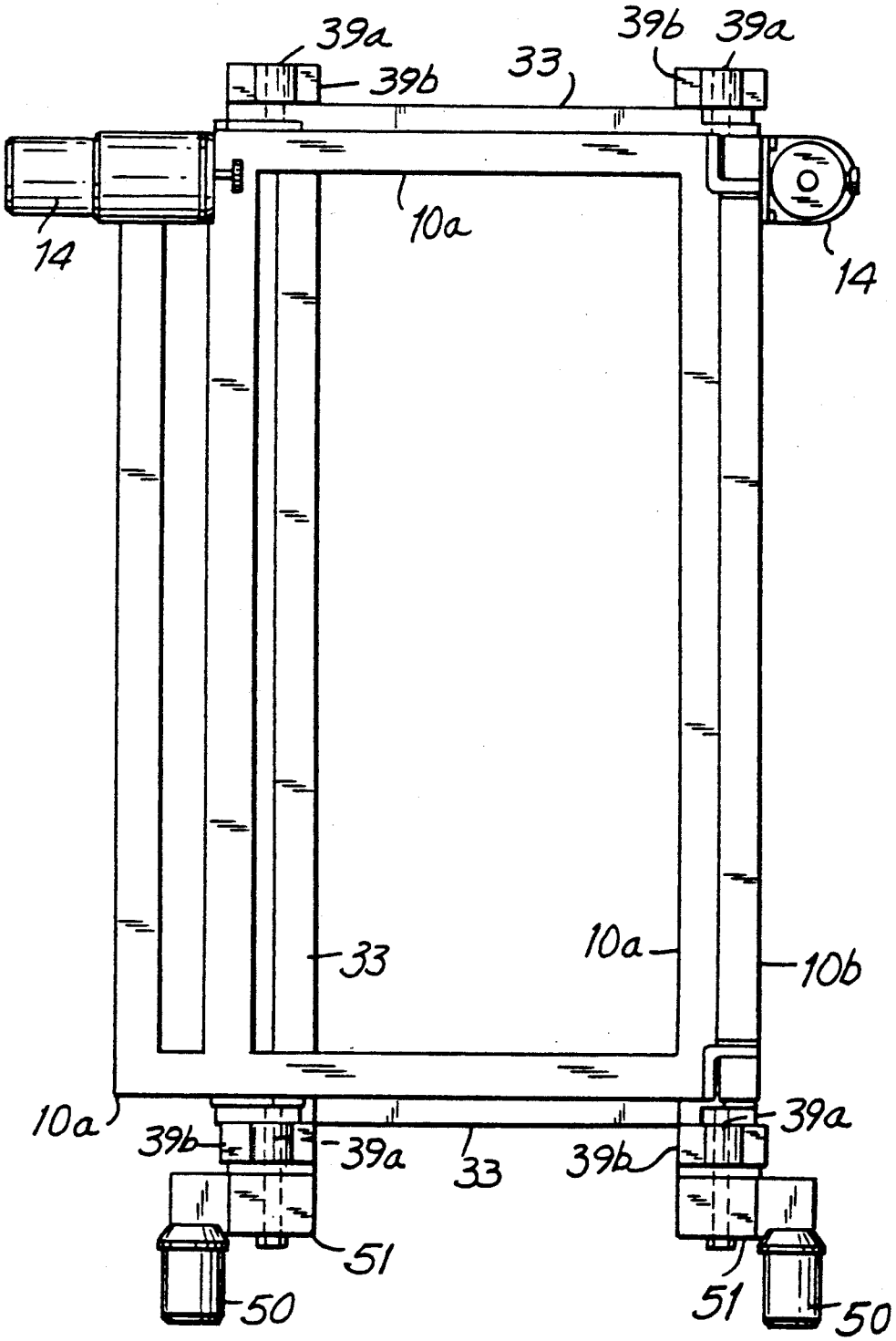
FIG. 14A is a top view of the embodiment shown in FIG. 14, with the doffers not shown for clarity.

FIG. 14A shows a top view of frames 10*a* and 10*b* mounted on subframe 33. Doffer elements 11, mounting blocks 22–28, and the drive assembly are not shown. Bushing blocks 39*b* are attached to subframe 33 and support stub shafts 39*a*. Tilt bed motors 50 and conventional gear boxes 51 are also attached to subframe 33. Gear boxes 51, driven by motors 50, rotate stub shafts 39*a* to raise and lower frames 10*a* and 10*b*. In FIG. 14A, frame 10*a* is shown in the horizontal position, whereas frame 10*b* is shown in the upright or vertical position.

In the flop assembly, doffer units may be alternatively brought into and out of engagement by means of tilt bed motors 50 which cause frames 10 to rotate about pivot means 39. Pivot means 39 may be of any type generally known in the art. Preferably, each unit is fully positively counterbalanced so that the mechanism's natural position is either up (the cleaning/maintenance position) or down (the operating position). The flop assembly is used in conjunction with a take away conveyor 41 located at the downstream end of the flop assembly for moving the cleaned tobacco on for further processing.

Figure 15:
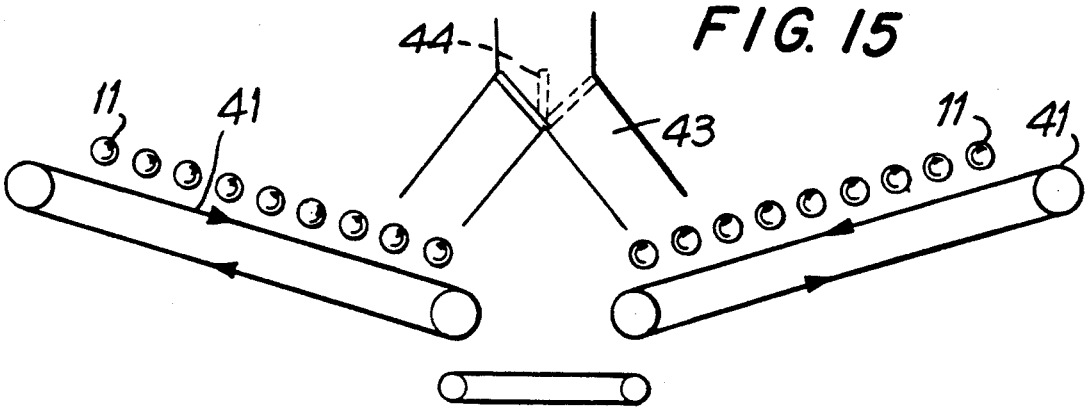
FIGS. 15–17 are diagrammatic side views of other embodiments of the present invention.
Figure 16:
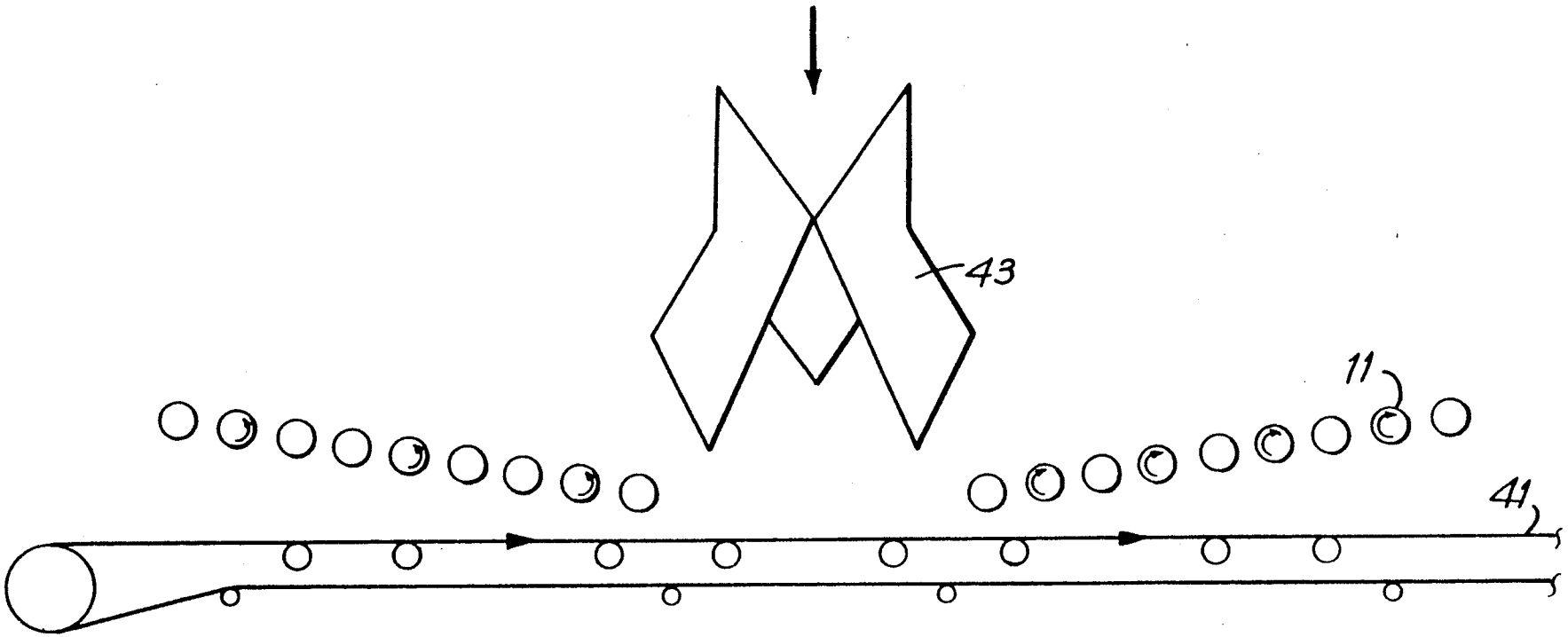
Figure 17:
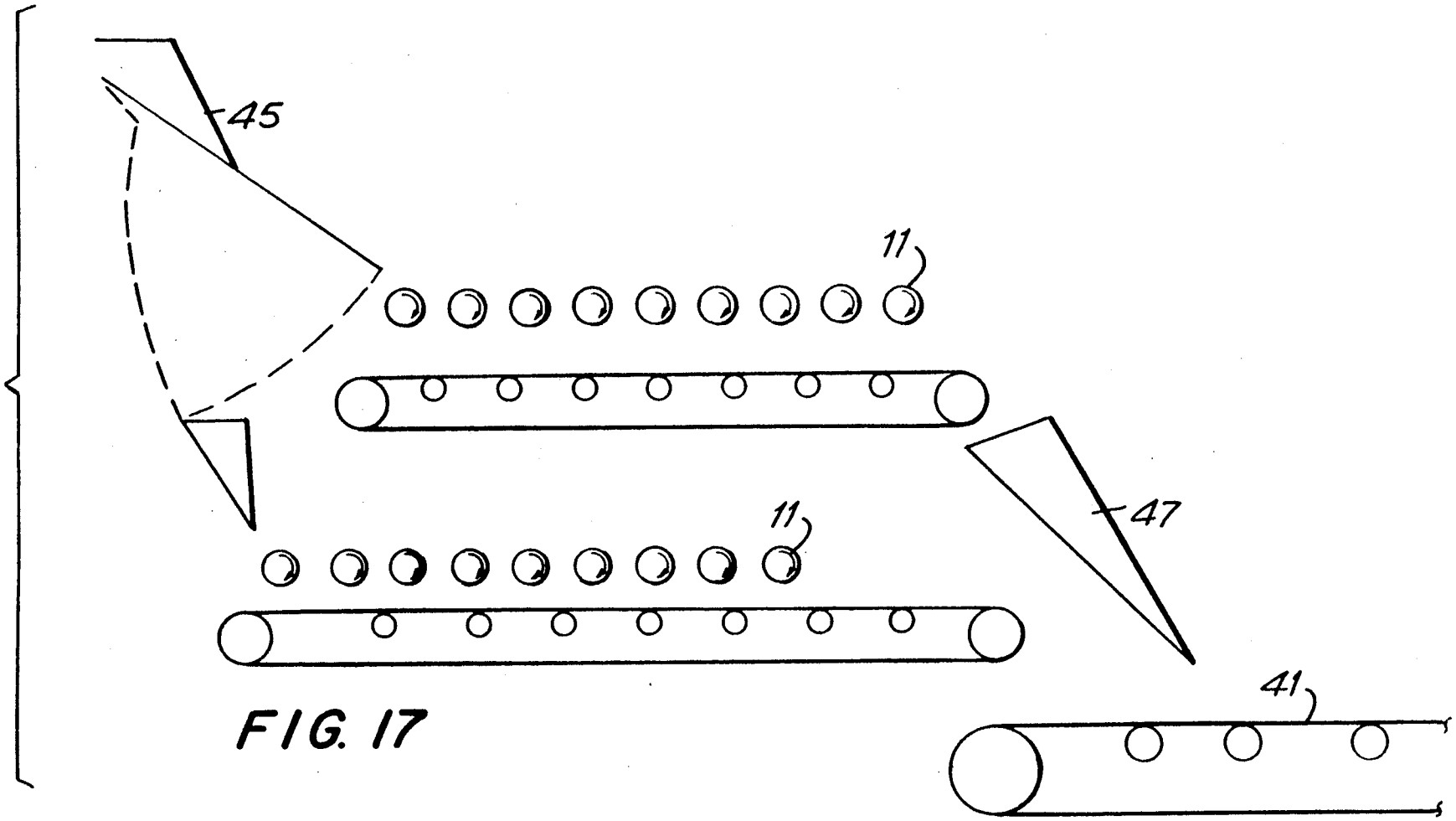

Other embodiments of the present invention are illustrated in FIGS. 15–17. As shown in FIG. 15, the mechanism may consist of a feed chute with a "pant leg" assembly 43 and opposing frames 10 containing rotating doffer elements 11. Thus, tobacco flows down one "leg" of chute 43, is processed through doffer elements 11 contained within one of the opposing frames 10 (not shown), and is moved on for further processing by conveyors 41. While tobacco is processed through one doffer unit, the other may be cleaned.

Alternatively, FIG. 16 illustrates the same basic embodiment as shown in FIG. 15 with a single take away conveyor. In these two embodiments, the pant leg assembly is useful because it eliminates the need for a movable conveyor for dropping tobacco onto the middle of the first doffer element 11.

Another alternative is illustrated in FIG. 17. In this assembly, doffer units, which are represented by doffers 11, are layered. This assembly makes use of a flop gate 45 and a drop chute 47. When the upper doffer unit is in use and the lower doffer unit is being cleaned, the flop gate 45 drops tobacco onto the upper doffer unit. After processing, tobacco travels through drop chute 47 onto take away conveyor 41. When the lower doffer unit is in use and upper doffer unit can be cleaned, flop gate 45 swings downwardly to deliver tobacco to the lower doffer unit. There is no need to use drop chute 47 as tobacco directly travels to take away conveyor 41.

Although the preferred use of the mechanism of the present invention relates to the removal of contaminants from a uniform flow of tobacco fed through the doffer elements, it is not limited to the purification of tobacco. Many types of materials can be purified using doffer elements in any of the embodiments described above.

We claim:

1. A doffer mechanism for removing contaminants from a stream of material comprising:

a frame having at least two oppositely disposed sides;

a plurality of doffer elements, each doffer element having two ends and an axis of rotation passing through the two ends;

means for mounting the two ends of each of the doffer elements to opposite sides of the frame at positions along the sides of the frame, such that the doffer elements are positioned across the plane of the frame and the axes of rotation of the plurality of doffer elements are substantially parallel, the means for mounting further comprising pivotal means for pivoting the doffer elements between a first position and a second position, the first position being substantially within the plane of the frame and the second position being substantially out of the plane of the frame;

means for rotating the plurality of doffer elements about their respective axes of rotation, the rotation of the doffer elements causing agitation of the stream of material such that the stream of material travels substantially in the direction of the rotation; and means for adjusting the elevation above or below the plane of the frame of at least one of the plurality of doffer elements.

2. The doffer mechanism according to claim 1 wherein the means for mounting the two ends of each of the doffer elements to the frame comprises a pair of blocks including bearing supports which attach to opposite sides of the frame.

3. The doffer mechanism according to claim 2 wherein the means for rotating the doffer elements further comprises a plurality of doffer sprockets attached to one end of each of the doffer elements, a plurality of idler sprockets attached to the blocks, and a motor driven continuous chain which engages both the idler sprockets and the doffer sprockets.

4. The doffer mechanism according to claim 1 wherein the means for adjusting the elevation of the doffer elements comprises a pair of bearing mounts, a pair of blocks which attach to opposite sides of the frame and means for adjustably fastening the bearing mounts to the blocks in at least two configurations.

5. The doffer mechanism according to claim 1 wherein the doffer elements are cylindrical hollow members.

6. The doffer mechanism according to claim 1 wherein each of the doffer elements has a surface and a plurality of elongated flights extending the length of the surface of the doffer elements.

7. The doffer mechanism according to claim 6 wherein each flight comprises an elongated rectangular bar.

8. The doffer mechanism according to claim 7 wherein the rectangular bars are mounted at 60 degree intervals about the surface of the doffer elements.

9. The doffer mechanism according to claim 6 wherein each of the flights has an exposed surface and a cleaning means attached to the exposed surface of each of the flights.

10. The doffer mechanism according to claim 9 wherein the cleaning means is a hook material.

11. The doffer mechanism according to claim 1 wherein the stream of material is tobacco leaves.

12. A doffer mechanism for removing contaminants from a stream of material comprising:

a frame having at least two oppositely disposed sides;

a plurality of doffer elements, each doffer element having two ends and an axis of rotation passing through the two ends;

means for mounting the two ends of each of the doffer elements to opposite sides of the frame at positions along the sides of the frame, such that the doffer elements are mounted across the frame and the axes of rotation of the plurality of doffer elements are substantially parallel;

means for rotating the plurality of doffer elements about their respective axes of rotation, and means for adjusting the elevation above or below the frame of at least one of the plurality of doffer elements, the means for adjusting the elevation comprising a pair of bearing mounts, a pair of blocks which attach to opposite sides of the frame and means for adjustably fastening the bearing mounts to the blocks in at least two configurations, the means for fastening including a plurality of holes in the block, with at least one hole corresponding to each possible elevation of at least one of the plurality of doffer elements.

13. A doffer mechanism for removing contaminants from a stream of material comprising:

a frame having at least two oppositely disposed sides;

a plurality of doffer elements, each doffer element having two ends and an axis of rotation passing through the two ends;

means for mounting the two ends of each of the doffer elements to opposite sides of the frame at positions along the sides of the frame, such that the doffer elements are positioned across the plane of the frame and the axes of rotation of the plurality of doffer elements are substantially parallel, the means for mounting further comprising pivotal means for pivoting the doffer elements between a first position and a second position, the first position being substantially within the plane of the frame and the second position being substantially out of the plane of the frame;

means for rotating the plurality of doffer elements about their respective axes of rotation, the rotation of the doffer elements causing agitation of the stream of material such that the stream of material travels substantially in the direction of the rotation; and means for selectively adjusting the positions along the sides and in the plane of the frame at which the ends of at least one doffer element are mounted to the frame.

14. The doffer mechanism according to claim 13 wherein the means for mounting the two ends of each of the doffer elements comprises a pair of blocks including bearing mounts which attach to opposite sides of the frame.

15. The doffer mechanism according to claim 14 wherein the means for selectively adjusting the positions along the sides of the frame comprises at least one T-shaped groove in the frame that slidably engages the head of at least one substantially T-shaped bolt whereby the substantially T-shaped bolt slidably mounts at least one block to the frame.

16. The doffer mechanism according to claim 14 wherein the means for rotating the doffer elements further comprises a plurality of doffer sprockets attached to the end of the doffer elements, a plurality of idler sprockets attached to the blocks, and a motor driven continuous chain which engages both the idler sprockets and the doffer sprockets.

17. The doffer mechanism according to claim 13 wherein the doffer elements are cylindrical hollow members.

18. The doffer mechanism according to claim 13 wherein each of the doffer elements has a surface and a plurality of elongated flights extending the length of the surface of the doffer elements.

19. The doffer mechanism according to claim 18 wherein each flight comprises an elongated rectangular bar.

20. The doffer mechanism according to claim 19 wherein the rectangular bars are mounted at 60 degree intervals about the surface of the doffer elements.

21. The doffer mechanism according to claim 18 wherein each of the flights has an exposed surface and a cleaning means attached to the exposed surface of each of the flights.

22. The doffer mechanism according to claim 21 wherein the cleaning means is a hook material.

23. The doffer mechanism according to claim 13 wherein the stream of material is tobacco leaves.

24. The doffer mechanism according to claim 13 further comprising means for adjusting the elevation above or below the frame of at least one of the plurality of doffer elements.

25. The doffer mechanism according to claim 24 wherein the stream of material is tobacco leaves.

26. A doffer mechanism for removing contaminants from a stream of material comprising:

a subframe;

a pair of frames of substantially the same size and shape, each of the frames being pivotally attached to the subframe so that each frame pivots about the subframe;

a plurality of doffer elements each having two ends and an axis of rotation, the ends of the doffer elements mounted to each of the frames such that the doffer elements are mounted across each of the frames, the axes of rotation of the doffer elements in each frame being substantially parallel;

means for rotating the plurality of doffer elements about their axes; and means for selectively pivoting each of the frames between a first, substantially horizontal position and a second, substantially vertical position.

27. The doffer mechanism according to claim 26 further comprising means for adjusting the elevation above or below the frame of at least one of the doffer elements in the frame.

28. The doffer mechanism according to claim 26 further comprising means for selectively adjusting the positions along the sides of the frame at which the ends of at least one doffer element are mounted to the frame.

29. The doffer mechanism according to claim 26 wherein each of the doffer elements has a surface and a plurality of elongated flights extending the length of the surface of the doffer elements.

30. The doffer mechanism according to claim 29 wherein each flight comprises an elongated rectangular bar.

31. The doffer mechanism according to claim 30 wherein the rectangular bars are mounted at 60 degree intervals about the surface of the doffer elements.

32. The doffer mechanism according to claim 26 wherein the doffer elements are cylindrical hollow members.

33. The doffer mechanism according to claim 29 wherein each of the flights has an exposed surface and a cleaning means attached to the exposed surface of each of the flights.

34. The doffer mechanism according to claim 33 wherein the cleaning means is a hoop material.

35. A doffer mechanism for removing contaminants from a stream of material comprising:

at least two frames of substantially the same size and shape;

a plurality of doffer elements, each doffer element having two ends and an axis of rotation passing through the two ends;

means for mounting the two ends of each of the doffer elements to opposite sides of the frames at positions along the sides of the frames, such that the doffer elements are mounted across the frames and the axes of rotation of the plurality of doffer elements in each frame are substantially parallel;

means for rotating the plurality of doffer elements about their respective axes of rotation;

means for selectively directing the stream of material to a selected one of the frames of doffer elements for removal of contaminants from the stream by the selected one of the frames of doffer elements.

36. The doffer mechanism according to claim 35 wherein the frames comprise a pair of frames, the frames being oppositely inclined with respect to one another.

37. The doffer mechanism according to claim 36 wherein the pair of frames is positioned such that the frames are positioned parallel to one another.

38. The doffer mechanism according to claim 36 wherein the means for selectively directing the stream comprises a feed chute having delivery ends located at a lower end of each inclined frame and means for changing the configuration of the feed chute to direct the flow of material from one of the frames to the other of the frames.

39. The doffer mechanism according to claim 37 wherein the means for selectively directing the stream comprises a pivotal delivery gate capable of feeding tobacco to a first frame when in a first position prior to pivoting and to a second frame when in a second position after pivoting.

40. The doffer mechanism according to claim 35 wherein the stream of material is tobacco leaves.

41. A doffer element for removing contaminants from a stream of material comprising:

a hollow tube having two ends and a central longitudinal axis passing through each of the two ends;

a pair of circular plates affixed at the ends of the hollow tube;

a shaft attached to each of the circular plates, each shaft having two ends such that the central longitudinal axis of the hollow tube passes through each of the two ends of each shaft; and;

means for affixing a cleaning surface to the doffer element.

42. The doffer element according to claim 41 wherein the doffer element has a surface and a plurality of elongated flights extending the length of the surface of the doffer elements.

43. The doffer element according to claim 42 wherein each flight comprises an elongated rectangular bar.

44. The doffer element according to claim 43 wherein the elongated rectangular bar is hollow.

45. The doffer element according to claim 42 wherein the flights are equidistantly mounted around the hollow cylindrical tube.

46. The doffer element according to claim 42 wherein each of the flights has an exposed surface and a cleaning means attached to the exposed surface of each of the flights.

47. The doffer mechanism according to claim 46 wherein the cleaning means is a hook material.

48. A doffer mechanism comprising:

a continuous chain, the chain having an inner surface and an outer surface;

means for driving the continuous chain;

a plurality of doffer elements, each doffer element having a doffer sprocket for converting the motion of the continuous chain into rotational motion for rotating the doffer element, at least one of the doffer sprockets being in contact with the outer surface of the continuous chain; and at least one idler sprocket, the idler sprocket contacting the inner surface of the continuous chain.

49. A doffer mechanism comprising:

a continuous belt, the belt having an inner surface and an outer surface;

means for driving the belt;

a plurality of doffer elements, each doffer element having a doffer drum for converting the motion of the continuous belt into rotational motion for rotating the doffer element, at least one of the doffer elements being in contact with the outer surface of the continuous belt; and at least one idler drum, the idler drum contacting the inner surface of the continuous belt.

* * * * *